US008640454B1

(12) United States Patent
Nord

(10) Patent No.: US 8,640,454 B1
(45) Date of Patent: Feb. 4, 2014

(54) LOWER COSTS AND INCREASED POWER DENSITY IN STIRLING CYCLE MACHINES

(76) Inventor: Jonathan P. Nord, Louisville, KY (US)

( * ) Notice: Subject to any disclaimer, the term of this patent is extended or adjusted under 35 U.S.C. 154(b) by 258 days.

(21) Appl. No.: 13/035,456

(22) Filed: Feb. 25, 2011

Related U.S. Application Data

(60) Provisional application No. 61/308,900, filed on Feb. 27, 2010.

(51) Int. Cl.
*F02G 1/04* (2006.01)

(52) U.S. Cl.
USPC ..... 60/520

(58) Field of Classification Search
USPC ..... 60/526, 517, 505, 520, 521–525
See application file for complete search history.

(56) References Cited

U.S. PATENT DOCUMENTS

| | | | | | |
|---|---|---|---|---|---|
| 3,527,049 | A * | 9/1970 | Bush | 60/521 |
| 3,698,182 | A * | 10/1972 | Knoos | 60/522 |
| 3,858,802 | A * | 1/1975 | Stobart | 237/12.1 |
| 3,996,745 | A * | 12/1976 | Davoud et al. | 60/517 |
| 5,394,700 | A * | 3/1995 | Steele | 60/525 |
| 5,735,123 | A * | 4/1998 | Ehrig | 60/525 |
| 6,877,314 | B2 * | 4/2005 | Pels | 60/517 |
| 2005/0172624 | A1 * | 8/2005 | Holecek et al. | 60/517 |

FOREIGN PATENT DOCUMENTS

| | | |
|---|---|---|
| GB | 777931 | 7/1957 |

* cited by examiner

*Primary Examiner* — Thomas Denion
*Assistant Examiner* — Shafiq Mian
(74) *Attorney, Agent, or Firm* — Camoriano and Associates; Theresa Camoriano; Guillermo Camoriano

(57) ABSTRACT

A Stirling Cycle device including a plurality of Stirling Cycle machines, each operating out of phase with the other Stirling Cycle machines and sharing at least one heat exchanger flow path.

6 Claims, 4 Drawing Sheets

Schematic for Exchanger Sharing in Near-Isothermal Stirling (M1,M2)

Schematic for Exchanger Sharing in Near-Isothermal Stirling (M3,M4)

LOWER COSTS AND INCREASED POWER DENSITY IN STIRLING CYCLE MACHINES

This application claims priority from U.S. Provisional Application Ser. No. 61/308,900 filed Feb. 27, 2010, which is hereby incorporated herein by reference.

BACKGROUND

The present invention relates to a method for reducing manufacturing costs and increasing the power density of Stirling Cycle machines (Stirling engines). More particularly, it relates to a method for sharing of heat exchangers among a plurality of Stirling Cycle machines.

Stirling engines differ from internal combustion engines in that they are driven by heat that is generated outside of the cylinder rather than inside. Since the heat is generated outside of the cylinder and is then transferred to the working gas through a heat exchanger, it may be generated by burning any of a wide variety of fuels or from the sun or any other heat source.

The Stirling engine performs a closed thermodynamic cycle, exchanging the working fluid between an expansion space and a separate compression space under substantially constant volume conditions, and transacting mechanical work with the working fluid as its volume increases or expands in the expansion space and decreases or contracts in the compression space.

SUMMARY

One embodiment of the present invention provides a Stirling Cycle engine including 4 Stirling Cycle machines M1, M2, M3, and M4 operating in a near-isothermal configuration. The four Stirling Cycle machines M1, M2, M3, and M4 share a single flow heater, a single flow cooler, and two regenerators. The heater, cooler, and regenerators are all heat exchangers which heat or cool the working fluid. There are various known types of Stirling Cycle machines, and, while only one type is shown here, the present invention, which allows Stirling Cycle machines to share heat exchangers, may be applied to any of those known types.

DESCRIPTION

Figure 1:
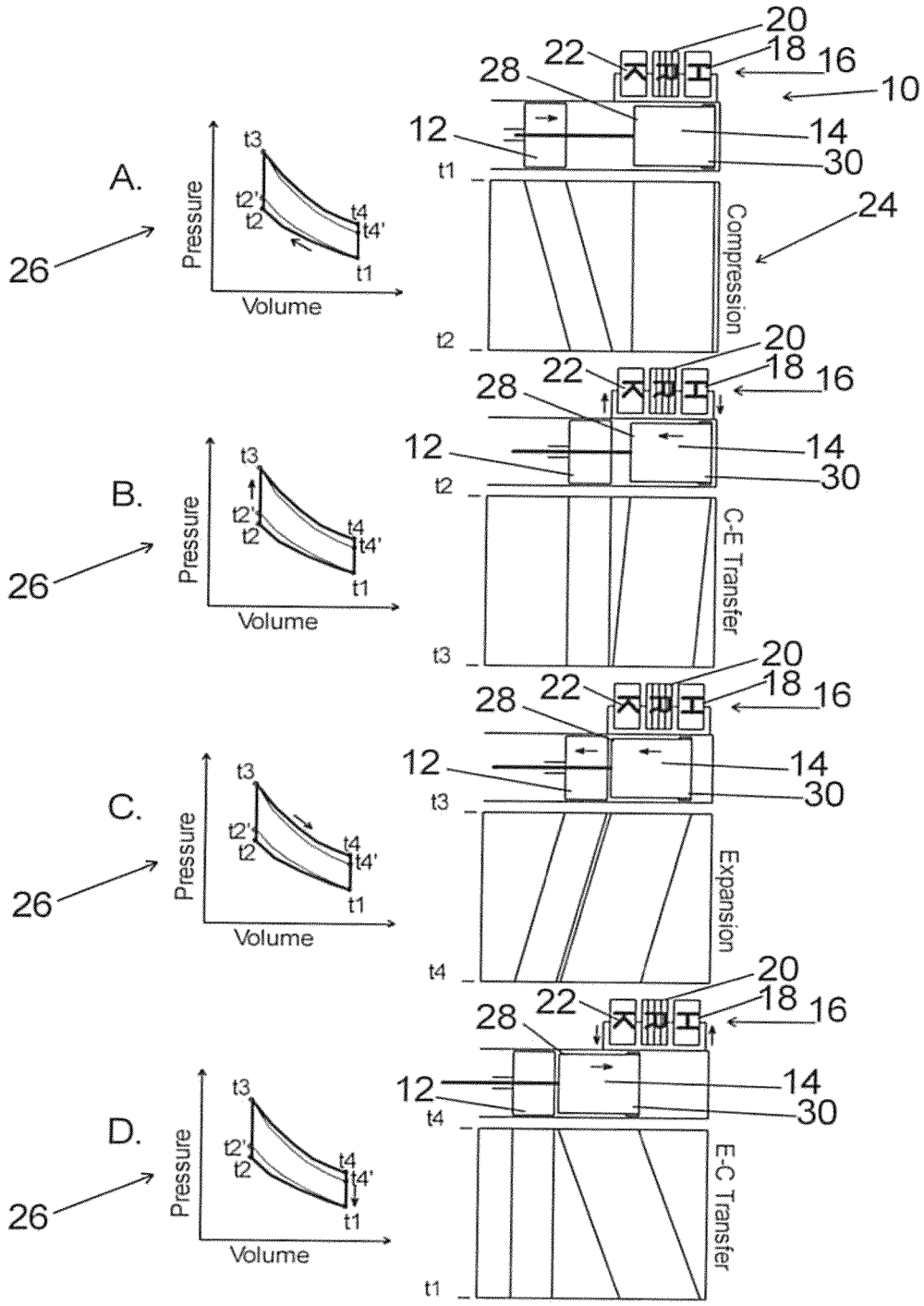
Figure 1 Prior Art
FIG. 1 is a sequential schematic showing the four phases of a standard prior art Stirling engine, the corresponding paths followed by the power and displacer pistons, and the corresponding Volume vs Pressure curve of the process at each phase of the process.

FIG. 1 is a schematic showing the four phases of a standard, prior art Stirling engine, namely:

1—Compression phase

2—Compression-Expansion Transfer phase (C-E phase)

3—Expansion phase

4—Expansion-Compression Transfer phase (E-C phase)

For each phase, there is a depiction of the Stirling engine 10 and the position of its power piston 12, its displacer piston 14, and its heat exchanger 16 (including a heater section 18 (also labeled H), a regenerator section 20 (also labeled R) and a cooler section 22 (also labeled K)). Directly beneath the depiction of each phase of the Stirling engine 10 there is a displacement chart 24 showing the path followed by the power piston 12 and the displacer piston 14 during that phase. Finally, just to the left of the depiction of each phase of the Stirling engine 10 is a graph 26 of Volume vs Pressure for the process, with the arrow within the graph 26 showing what is changing during that phase.

For instance, in phase A (shown on top and labeled Compression), the displacer piston 14 is to the far right and the power piston 12 is being pushed to the right, compressing the working fluid in the Stirling engine 10. The graph 26 shows that the volume is being reduced and that, as this happens, the pressure rises along the curve shown by the arrow in the graph 26 from t1 to t2. This would be the case in a truly isothermal process. However, the process is actually adiabatic, so the temperature rise resulting from compression results in an increased rate of pressure increase, resulting in the pressure indicated at t2'. The area below the t1 to t2' curve represents the amount of work which goes into the Stirling engine 10 during this phase of the process.

Note that the space 28 to the left of the displacer piston 14 is the compression space, and this end of the displacer piston 14 may be referred to as the compression end or cool end, while the space 30 to the right of the displacer piston 14 is the expansion space, and this end of the displacer piston 14 may be referred to as the expansion end or hot end. During this first phase, there is no flow through the heat exchanger 16 (the cooler 22, regenerator 20, and heater 18) because the displacer piston 14 does not move to allow the working fluid to enter the expansion space 30. The only thing that is happening is that the working fluid is being compressed by the movement of the power piston 12 toward the displacer piston 14.

In phase B (labeled as C-E transfer), the power piston 12 remains static while the displacer piston 14 moves to the left (to the starting position shown in the third phase). The movement of the displacer piston 14 to the left causes the working fluid to move through the heat exchanger 16 (through all three sections; the cooler 22, the regenerator 20, and the heater 18). During this phase, the working fluid increases in pressure to the value indicated at time t3 due to the heat energy absorbed in the regenerator R and heater H, with the volume remaining unchanged, as shown in the corresponding graph 26.

Note that the working fluid travels through the heat exchanger 16 from left to right as the displacer piston 14 travels from right to left. The displacer piston 14 is pushing the working fluid through the heat exchanger 16. This is labeled C-E transfer because the working fluid is transferred through the heat exchanger 16 from the Compression (C) space 28 on one side of the displacer piston 14 to the Expansion (E) space 30 on the other side of the displacer piston 14.

In phase C (labeled Expansion), the heated working fluid expands, both the power piston 12 and the displacer piston 14 move to the left, and there is no flow through the heat exchanger 16. The graph 26 shows that the volume is being increased and that, as this happens, the pressure drops along the curve shown by the arrow in the graph 26 from t3 to t4'. The temperature drop resulting from expansion results in an increased rate of pressure decrease, resulting in the pressure indicated at t4'. The area below the t3 to t4' curve represents the amount of work released during the process. The difference between the area below the t3 to t4' curve and the area below the t1 to t2' curve is the net amount of work available from the process.

Finally, in phase D (labeled E-C transfer), the displacer piston 14 moves back to the right (to the starting position of phase A). The working fluid moves back through the heat exchanger 16 (through all three sections; the heater 18, the regenerator 20, and the cooler 22) and the pressure is reduced as the working fluid is cooled, with the volume remaining unchanged, as shown in the corresponding graph.

The Near-Isothermal Configuration of the Stirling Engine

It may be appreciated that, if some heat could be removed from the working fluid during phase A (Compression) such that the increasing temperature is held near the temperature of the cooler K, and if some heat could be added to the working fluid during phase C (Expansion) such that the decreasing temperature is held near the temperature of the heater H, the difference in the area between the curves would be greater, meaning that the process would be made more efficient (and more nearly iso-thermal).

Near isothermal compression and expansion may be achieved by modifying the standard Stirling machine to circulate the working gas through an appropriate heat exchanger during the volume change processes in which work is exchanged with the working gas. For instance, during compression (Phase A), the working fluid can be circulated by a blower through a path including a cooler, and, during expansion (Phase C), the working gas can be circulated by a blower through a path including a heater. Circulation through the appropriate cooler or heater (cooling heat exchanger or heating heat exchanger) during the volume change processes provides heat exchange to substantially counteract the heating and cooling of the working gas which occurs during compression and expansion, respectively. Because the heater and its blower and the cooler and its blower work in conjunction to accomplish the goal of heat transfer in the Near-Isothermal Stirling Cycle as referenced above, for simplicity hereafter, the combination of the heater and blower will be referred to as a flow heater (FH), and the combination of the cooler and blower will be referred to as a flow cooler (FK).

When near-isothermal expansion and compression are accomplished via the method referenced above, the working gas remains near the heater and cooler temperatures through the compression and expansion work processes. Therefore, the hot and cold ends of the regenerator are maintained at near the heater and cooler temperatures by the gas exiting the compression and expansion spaces, respectively, and the heater the cooler are not needed following expansion and compression, respectively. Furthermore, because the temperatures of the regenerator hot and cold ends are maintained near the temperature of the heater and cooler, respectively, by the exit temperatures of the expansion and compression processes, no pre-heating or pre-cooling is needed from the heater or cooler.

A careful analysis of the four phases of the Stirling engine 10 of FIG. 1 reveals that, under certain operating conditions, wherein each phase of the Stirling engine 10 cycle has substantially the same time duration $t_p$, the regenerator 16 is in use only half of the time (during the C-E transfer and again during the E-C transfer) and is otherwise idle the rest of the time. Also, in the case of a near-isothermal Stirling engine as described above, a flow cooler FK is only used during the first phase (Compression) to cool the working fluid such that its temperature is maintained at near the temperature of the cooler K. Similarly, a flow heater FH is only used during the third phase (Expansion) to heat the working fluid such that its temperature is maintained near the temperature of the heater K. That is, the flow heater FH and the flow cooler FK each are in use only ¼ of the entire cycle, and sit idle the rest of the time.

This makes it possible to provide an improved Stirling engine 10' (shown in FIG. 2), including four Stirling cycle machines 10', which are labeled M1, M2, M3, and M4, each operating approximately 90 degrees out of phase from the previous Stirling Cycle machine 10', and sharing two regenerators R1, R2, one flow cooler FK, and one flow heater FH. The piping and valves that are connected to the machines 10' and allow the sharing of the regenerators, flow cooler and flow heater are shown schematically to the left of the machines 10' and are explained below. The positions of the valves may be controlled electrically or mechanically.

Figure 2:
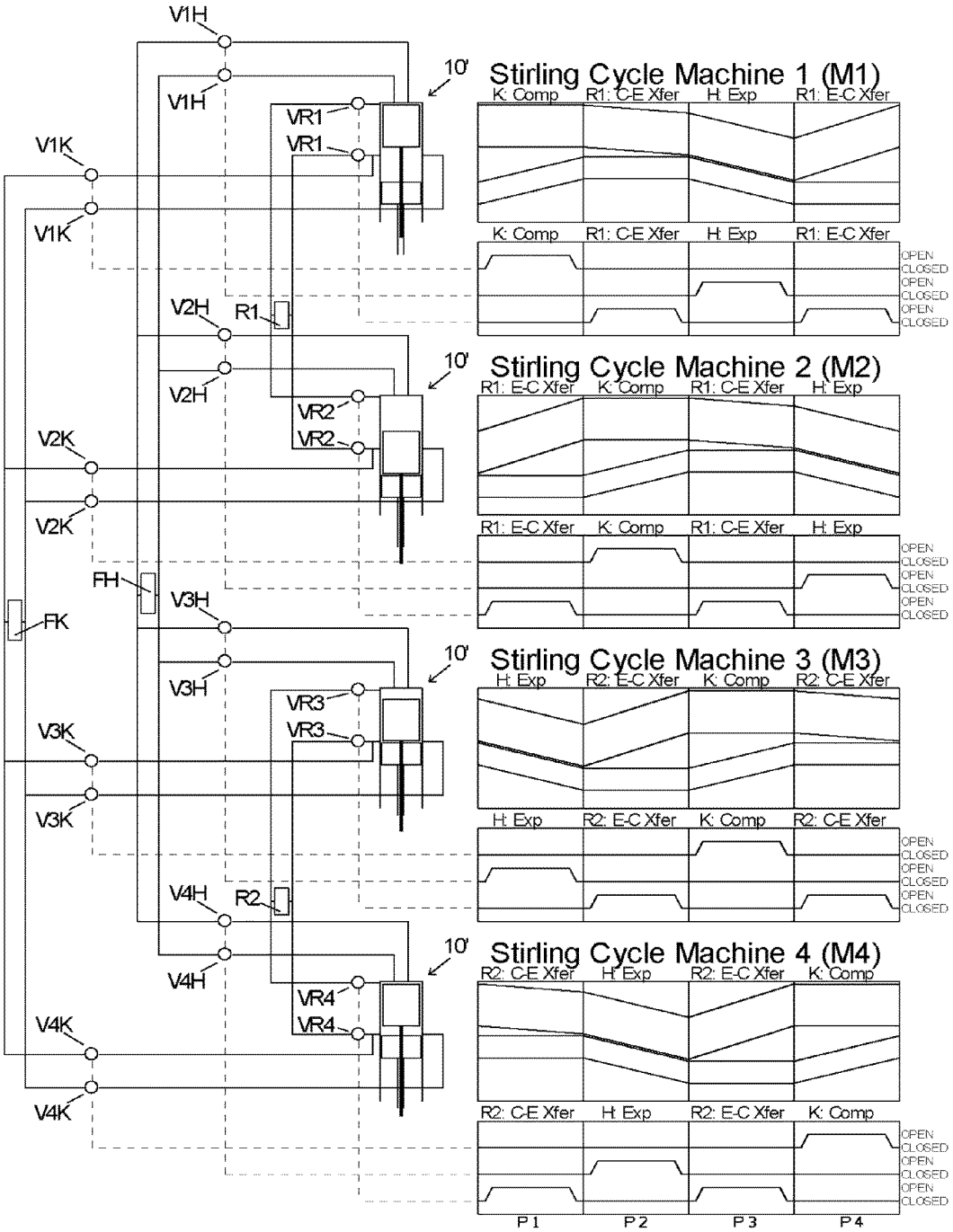
FIG. 2 is an overall schematic view of a near-isothermal embodiment of a shared heat exchanger Stirling Cycle machine.
Figure 3:
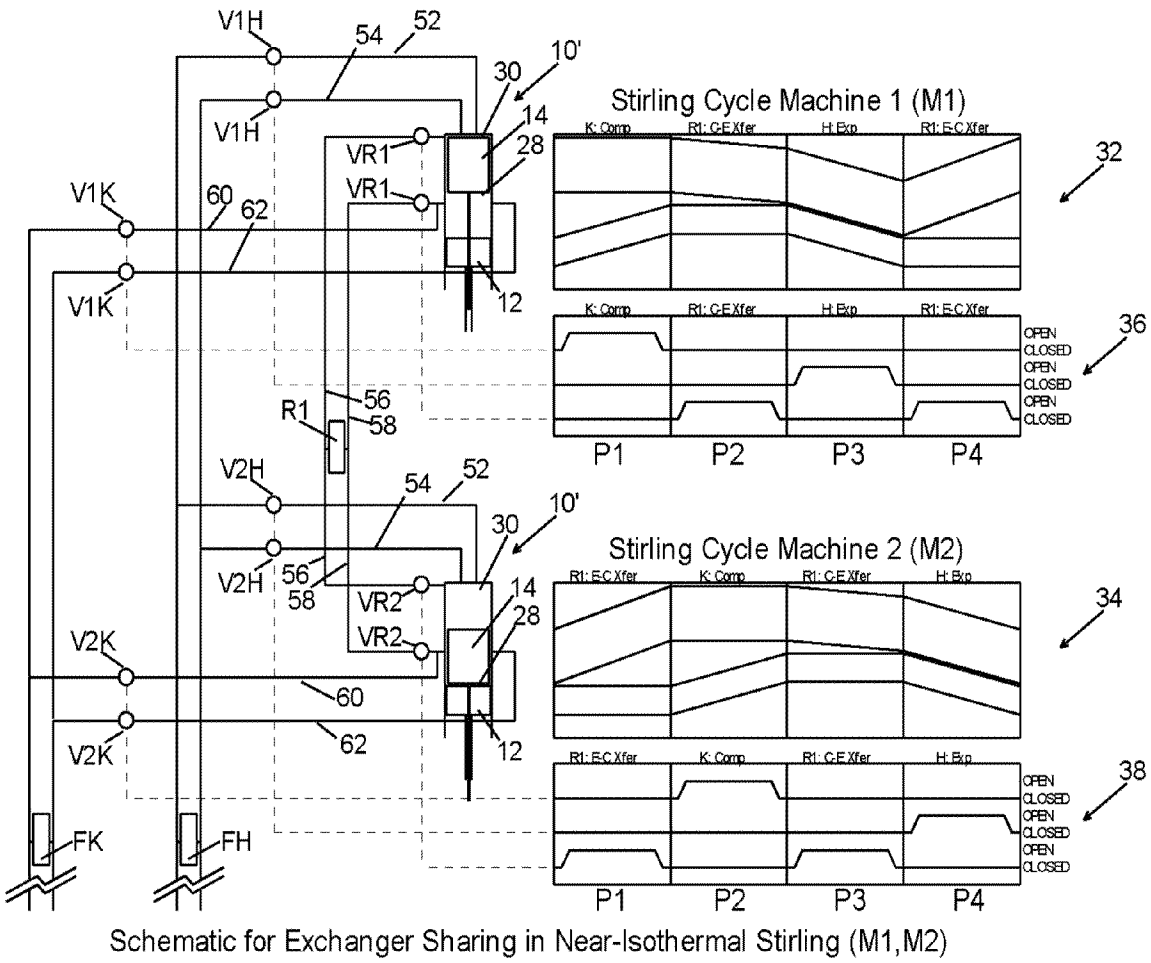
FIG. 3 is an enlarged view of the top portion of the schematic of FIG. 2.

FIG. 3 is an enlargement of the upper portion of FIG. 2. It shows the Stirling Cycle machines 10' labeled M1 and M2, and their corresponding displacement charts 32, 34 (showing the position and movement of both the power piston 12 and the displacer piston 14 for each Stirling Cycle machine M1, M2). Also shown is a Valve-position matrix chart 36, 38 for each Stirling Cycle machine M1, M2, indicating the open or closed condition of the valves which connect to, or isolate from, the one shared regenerator R1, the flow cooler FK, and the flow heater FH to each of the Stirling Cycle machines M1, and M2, as described below.

For the first machine M1, there are two lines 52, 54 which allow working fluid to pass from the expansion space 30 on the hot side of the displacer piston 14, through the flow heater FH, and back to the expansion space 30 on the hot side of the displacer piston 14, via valves V1H. There are also two lines 56, 58, which allow working fluid to pass from the expansion space 30 on the hot side of the displacer piston 14 through the regenerator R1 to the compression space 28 on the cold side of the displacer piston 14 via valves VR1. There are also two lines 60, 62, which allow working fluid to pass from the compression space 28 on the cold side of the displacer piston 14 through the flow cooler FK and back to the compression space 28 on the cold side of the displacer piston 14 via valves V1K. This arrangement is repeated for the second machine M2, except, in that case, the valves are labeled V2H, VR2, and V2K, respectively. It is understood that the aforementioned lines and valves, when open, provide flowpaths such that the machine M1 or M2 is in fluid communication with the corresponding flow heater FH, flow cooler FK, or regenerator R1, and that these flowpaths are reversible. That is, the flow of the working fluid through the lines and valves may be in either direction, as required.

Still referring to FIG. 3, the phases are labeled P1, P2, P3, and P4 for each Stirling Cycle machine 10'. For instance, for the Stirling Cycle machine M1, the first phase P1 corresponds to the compression phase in which cooling of the working fluid is desirable to keep the temperature along the curve t1-t2 (see graph 26 on top left of FIG. 1) instead of the curve t1-t2', so as to operate in the more efficient, near-isothermal mode discussed above. In this case, both valves V1K are open in phase 1 (P1), as shown by the valve matrix chart 36 for the Stirling Cycle machine M1, under phase P1. This opens a flowpath to have the compression space 28 of the Stirling Cycle machine M1 in fluid communication with the flow cooler FK through the lines 60, 62. As explained earlier, the flow cooler includes a cooler and a blower to circulate the working fluid from the compression space 28 of the Stirling Cycle machine M1 to the flow cooler FK and back to the compression space 28 of the Stirling Cycle machine M1. All the other valves V1H and VR1 are closed in the compression phase, so there is no other open flowpath from the Stirling Cycle machine M1, either to the flow heater FH or to the regenerator R1.

During the second phase P2 (the C-E transfer phase) of the Stirling Cycle machine M1, the valves V1K are both closed, as are the valves V1H, so there is no open flowpath from the Stirling Cycle machine M1 to either the flow cooler FK or the flow heater FH. However, the valves VR1 are both open, opening a flowpath to the regenerator R1 through the lines 56, 58. This places the compression space 28 on one side of the displacer piston 14 and the expansion space 30 on the other side of the displacer piston 14 in fluid communication with each other and with the regenerator R1. As explained earlier with respect to the standard Stirling engine 10, the movement of the displacer piston 14 forces the working fluid from the compression space 28, through the regenerator R1, to the expansion space 30.

During the third phase P3, corresponding to the expansion phase, heating of the working fluid is desirable to keep the temperature along the curve t3-t4 (see graph 26 on top left of FIG. 1) instead of the curve t3-t4', so as to operate in the more efficient, near-isothermal mode discussed above. In this case, both valves V1H are open, as shown by the valve matrix chart 36 for the Stirling Cycle machine M1. This opens a flowpath through lines 52 and 54 to have the working fluid flow from the expansion space 30 of the Stirling Cycle machine M1 through the flow heater FH and back to the Expansion space 30 of the Stirling Cycle machine M1. As defined earlier, the flow heater FH includes a heat exchanger and a blower to circulate the working fluid. All the other valves V1*k* and VR1 are closed, so there is no other open flowpath from the Stirling Cycle machine M1, either to the flow cooler FK or to the regenerator R1.

During the fourth phase P4 (the E-C transfer phase) of the Stirling Cycle machine M1, the valves V1K are both closed, as are the valves V1H, so there is no open flowpath from the Stirling Cycle machine M1 to either the flow cooler FK or the flow heater FH. However, the valves VR1 are both open, opening a flowpath through lines 56, 58 to the regenerator R1. This places the Compression space 28 and the Expansion space in fluid communication with each other and with the regenerator R1. As explained earlier with respect to the standard Stirling engine 10, the movement of the displacer piston 14 forces the working fluid from the Compression space 28, through the regenerator R1, and then to the Expansion space 30.

Referring now to the Stirling Cycle machine M2 in FIG. 3, it may be appreciated that it is operating 90 degrees out of phase with the Stirling Cycle machine M1. This can be confirmed by observing that the second phase P2 of the Stirling Cycle machine M2 is identical to the first phase P1 of the Stirling Cycle machine M1 (they are both compression stages). All the valve settings for these two Stirling Cycle machines M1, and M2 are also 90 degrees out of phase. That is, the valve settings for phase 4 (P4) of the Stirling Cycle machine M2 is identical to the valve settings for phase 3 (P3) of the Stirling Cycle machine M1. Likewise, the valve settings for phase 3 (P3) of the Stirling Cycle machine M2 is identical to the valve settings for phase 2 (P2) of the Stirling Cycle machine M1. This same condition is true for all the phases, wherein the valve settings for phase N (PN) of the Stirling Cycle machine M2 is identical to the valve settings for phase N−1 (PN−1) of the Stirling Cycle machine M1.

A quick review of the valve settings for these two Stirling Cycle machines M1, and M2 reveals that the valve sequences do not allow the flow heater FH, the flow cooler FK, or the regenerator R1 to be in fluid communication with both of the Stirling Cycle machines M1, and M2 at the same time. For instance, when the valves V2K open up fluid communication from the compression space 28 of the Stirling Cycle machine M2 to the flow cooler FK (in phase 2 (P2)) of the Stirling Cycle machine M2), the corresponding valves V1K of the Stirling Cycle machine M1 are closed. Likewise, when the valves VR2 open fluid communication from the compression space 28 to the regenerator R1 and then to the expansion space 30 of the Stirling Cycle machine M2 (in phases 1 and 3 (P1 and P3) of the Stirling Cycle machine M2), the corresponding valves VR1 of the Stirling Cycle machine M1 are closed.

It should be noted that the working fluid of machine M2 flows along the same path within the regenerator R1 as did the working fluid of the first machine M1. The working fluid of machine M2 also flows along the same paths within the flow cooler FK and flow heater FH as did the working fluid of the first machine M1. This enables the machines M1 and M2 to share the regenerator R1, flow cooler FK and flow heater FH, with their working fluids flowing along the same flow paths within those devices, thereby creating savings in material and manufacturing costs.

Figure 4:
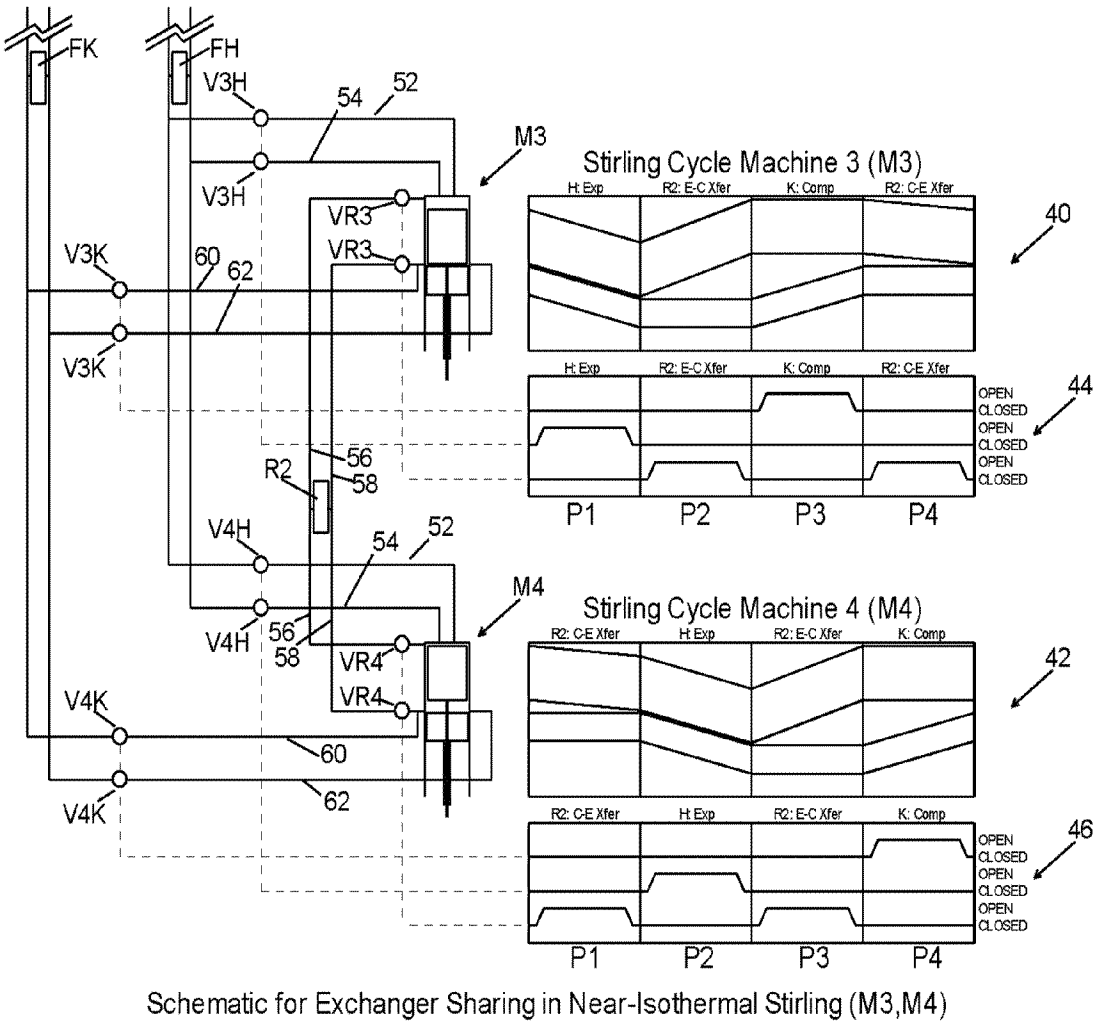
FIG. 4 is an enlarged view of the bottom portion of the schematic of FIG. 2.

From here it is a simple matter to expand the comparison to the two additional Stirling Cycle machines M3, and M4 shown in FIG. 2 and enlarged in FIG. 4. These machines share the same flow cooler FK and flow heater FH as the first two machines M1 and M2, and they share a second regenerator R2.

Comparing the displacement charts 32, 34, 40, 42 for the Stirling Cycle machines M1, M2, M3, and M4 respectively, it is clear that each of these Stirling Cycle machines M1, M2, M3, and M4 is 90 degrees out of phase with its previous Stirling Cycle machine. For instance, phase 4 (P4) of the Stirling Cycle machine M4 (the Compression stage) is identical to phase 3 (P3) of the Stirling Cycle machine M3, which in turn is identical to phase 2 (P2) of the Stirling Cycle machine M2, which again is identical to phase 1 (P1) of the Stirling Cycle machine M1.

Comparing the valve settings matrices 36, 38, 44, 46 of all four Stirling Cycle machines M1, M2, M3, and M4, respectively, it is apparent that the valve sequences do not allow the flow heater FH or the flow cooler FK to be in fluid communication with more than one of the Stirling Cycle machines M1, M2, M3, and M4 at any one time. In this way, all four machines M1, M2, M3 and M4 are able to send their working fluid along the same flow path within the respective shared devices FH, FK, and the two machines M3 and M4 are able to send their working fluid along the same flow path within the shared regenerator R2.

The valve sequences for the regenerator valves VR1 for the Stirling Cycle machine M1 are open in phases P2 and P4. These are the same for the valves VR3 for the Stirling Cycle machine M3 (also open during the same two phases P2 and P4), but they open a flow path for fluid communication of the Stirling Cycle machine M3 to the second regenerator R2 instead of to the first regenerator R1. Therefore, again, it is apparent that the valve sequences do not allow either the flow heater FH, nor the flow cooler FK, nor the regenerators R1, R2 to be in fluid communication with more than one of the Stirling Cycle machines M1, M2, M3, and M4 at any one time.

Again, this allows the four Stirling Cycle machines M1, M2, M3, and M4 to share a single flow heater FH, a single flow cooler FK, and two regenerators R1, R2, since the four Stirling Cycle machines M1, M2, M3, and M4 are designed to operate substantially out of phase from each other, and the process time for each phase is substantially equal to the process time for each of the other phases for all of the Stirling Cycle machines M1, M2, M3, and M4.

It will be obvious to those skilled in the art that modifications may be made to the embodiments described above without departing from the scope of the present invention as claimed.

What is claimed is:

1. A Stirling cycle device, comprising:

first and second Stirling cycle machines, each of said Stirling cycle machines defining a compression space and a separate expansion space;

a first heater defining a first heater flow path;

a first flow path from the expansion space of said first Stirling cycle machine through said first heater flow path and back to said expansion space of said first Stirling cycle machine;

a second flow path from the corresponding expansion space of said second Stirling cycle machine through said first heater flow path and back to said corresponding expansion space of said second Stirling cycle machine; and means for selectively opening said first flow path while closing said second flow path and for selectively opening said second flow path while closing said first flow path.

2. A Stirling cycle device as recited in claim 1, and further comprising third and fourth Stirling cycle machines, each of said third and fourth Stirling cycle machines defining a compression space and a separate expansion space;

a third flow path from the corresponding expansion space of said third Stirling cycle machine through said first heater flow path and back to said corresponding expansion space of said third Stirling cycle machine;

a fourth flow path from the corresponding expansion space of said fourth Stirling cycle machine through said first heater flow path and back to said corresponding expansion space of said fourth Stirling cycle machine;

and means for selectively opening said third flow path while closing said first, second and fourth flow paths and for selectively opening said fourth flow path while closing said first, second and third flow paths.

3. A Stirling cycle device as recited in claim 1, and further comprising a first cooler, defining a first cooler flow path;

a fifth flow path from the compression space of the first Stirling cycle machine through said first cooler flow path and back to the compression space of the first Stirling cycle machine; and a sixth flow path from the compression space of the second Stirling cycle machine through said first cooler flow path and back to the compression space of the second Stirling cycle machine; and means for selectively opening the fifth flow path while closing the sixth flow path and for selectively closing the fifth flow path while opening the sixth flow path.

4. A Stirling cycle device as recited in claim 2, and further comprising a first cooler, defining a first cooler flow path;

a fifth flow path from the compression space of the first Stirling cycle machine through the first cooler flow path and back to the compression space of the first Stirling cycle machine;

a sixth flow path from the compression space of the second Stirling cycle machine through the first cooler flow path and back to the compression space of the second Stirling cycle machine;

a seventh flow path from the compression space of the third Stirling cycle machine through the first cooler flow path and back to the compression space of the third Stirling cycle machine;

an eighth flow path from the compression space of the fourth Stirling cycle machine through the first cooler flow path and back to the compression space of the fourth Stirling cycle machine;

and means for selectively opening each one of the fifth, sixth, seventh and eighth flow paths while closing the rest of the fifth, sixth, seventh and eighth flow paths.

5. A Stirling cycle device as recited in claim 4, and further comprising first and second regenerators, defining first and second regenerator flow paths, respectively; means for selectively putting the compression and expansion spaces of the first and second machines in fluid communication with the first regenerator flow path; and means for selectively putting the compression and expansion spaces of the third and fourth machines in fluid communication with the second regenerator flow path.

6. A method for operating a plurality of Stirling cycle machines, comprising the steps of:

operating at least first and second Stirling cycle machines out of phase with each other, wherein each of said first and second Stirling cycle machines has a cylinder with separate first and second spaces;

putting the first space of the cylinder of the first machine in fluid communication with a first heat exchanger flow path and allowing the working fluid of the first machine to flow from said first space of the cylinder of the first machine through said first heat exchanger flow path and back to the first space of the cylinder of the first machine while isolating the cylinder of the second machine from the first heat exchanger flow path; and then putting the corresponding first space of the cylinder of the second machine in fluid communication with the first heat exchanger flow path and allowing the working fluid of the second machine to flow from the corresponding first space of the cylinder of the second machine through the first heat exchanger flow path and back to the corresponding first space of the cylinder of the second machine while isolating the cylinder of the first machine from the first heat exchanger flow path.

* * * * *